United States Patent [19]

Kawashima

[11] Patent Number: 4,490,928

[45] Date of Patent: Jan. 1, 1985

[54] MID-SOLE OF A SHOE

[75] Inventor: Yukio Kawashima, Akashi, Japan

[73] Assignee: Mizuno Corporation, Osaka, Japan

[21] Appl. No.: 516,358

[22] Filed: Jul. 22, 1983

[51] Int. Cl.[3] ..... A43B 23/08

[52] U.S. Cl. ..... 36/69; 36/82

[58] Field of Search ..... 36/28, 71, 82, 69, 31, 36/43, 30 R

[56] References Cited

U.S. PATENT DOCUMENTS 2,156,532 5/1939 Greider ..... 36/82 X 4,354,318 10/1982 Frederick et al. ..... 36/69 X 4,360,027 11/1982 Friedlander et al. ..... 128/615 X 4,364,188 12/1982 Turner et al. ..... 36/30 R X

*Primary Examiner*—Henry S. Jaudon

*Assistant Examiner*—Tracy G. Graveline

*Attorney, Agent, or Firm*—Fleit, Jacobson, Cohn & Price

[57] ABSTRACT

A mid-sole comprises a sole body of resilient foam material and a horseshoe-shaped rigid synthetic resin plate placed on the upper surface of the heel section of the sole body along the periphery thereof. At least one leg extends downwardly from the underside of the plate adjacent the inside portion of the heel section over its thickness to prevent the inner portion from inclining inwardly when a load is imposed on the inner portion of the heel section.

3 Claims, 4 Drawing Figures

MID-SOLE OF A SHOE

This invention relates to a mid-sole suitable for use with sports shoes, such as jogging shoes, school shoes and the like, which is adapted to increase the stability of the inside portion of the heel and to provide good shock absorption, cushioning and wearing comfort, thereby reducing fatigue of the foot.

In a sports shoe used for jogging and the like, a mid-sole of resilient foam material such as urethane foam has been mainly utilized for absorbing shock during each step. On the other hand, a sheet of hard plastic has been used as the insole in order to increase stability during running. It has been also proposed to provide mid-soles whose heel portion is made of foam material having a relatively low elasticity.

Such a mid-sole of resilient foam material is effective in absorbing the shock; however, when the weight of a wearer is imposed upon the heel of the shoe adjacent the inside portion of the heel during each step, the inside portion of the heel is compressed to an inwardly inclined position which would cause instability to lead to a fall of the wearer or his foot sprain. On the other hand, the mid-sole whose heel portion is made of foam material having the relatively low elasticity will provide good stability of the heel but result in low shock absorption and cushioning and hence in poor wearing comfort so that the wearer is extrimely fatigued with his long running.

Therefore, a main object of the present invention is to provide a mid-sole which has excellent shock absorption, prevents the inside portion of the heel from excessively inclining to provide high stability during each step and avoids any concentration of the shock to be exerted on the inside portion of the heel.

According to the present invention, this object is achieved by providing a mid-sole comprising a sole body of resilient foam material a horseshoe-shaped rigid synthetic resin plate placed on the heel section of the body in a flush relationship with its upper surface and including integral leg means extending downwardly from the horseshoe-shaped plate adjacent the inside portion of the heel section and embedded in the inside portion.

The object and advantages of the invention will become apparent from the following description of an embodiment thereof with reference to the accompanying drawings, in which.

Figure 1:
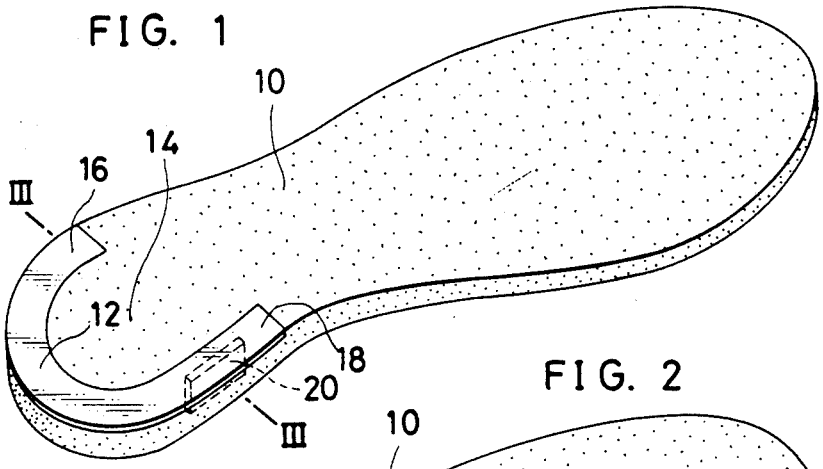
FIG. 1 is a perspective view of an embodiment of a mid-sole according to the present invention.
Figure 3:
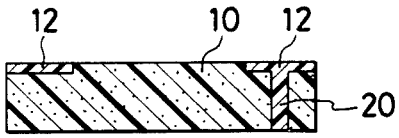
FIG. 3 is a cross-sectional view of the mid-sole taken along line III—III of FIG. 1.

Referring to FIGS. 1 and 3 of the drawings, there is shown a mid-sole of a shoe according to the present invention and the mid-sole comprises a sole body 10 of resilient foam material and a horseshoe-shaped rigid synthetic resin plate 12 having a desired width and extending along the upper periphery of the heel section

14 of the sole body 10. The horseshoe-shaped plate 12 has its outer portion 16 extending within the heel area and the inner portion 18 positioned adjacent the inner portion of the heel section and extending toward the arch area and is placed on the heel section 14 of the sole body 10 in a flush relationship with its upper surface. The plate 12 is provided with a narrow leg 20 extending downwardly from the underside of the inner portion 18 over the thickness of the heel section 14 of the sole body and embedded in the inner portion of the heel section 14. The leg 20 may be of a width smaller than that of the horseshoe-shaped synthetic resin plate 12.

Figure 2:
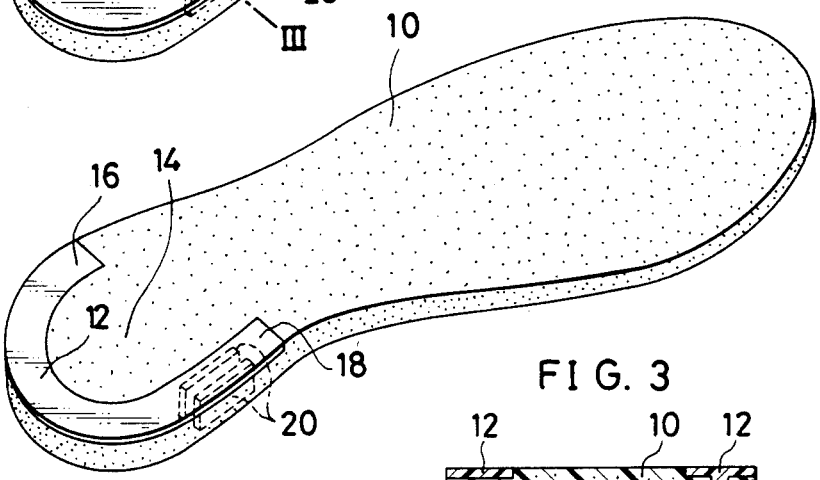
FIG. 2 is a view similar to FIG. 1 but showing another embodiment of the mid-sole.
Figure 4:
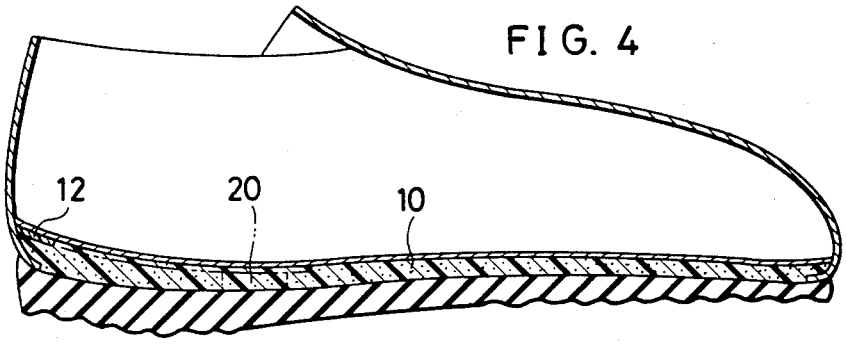
FIG. 4 is a longitudinal cross-sectional view of a shoe to which the mid-sole according to the invention is applied.

Referring to FIG. 2 of the drawings, there is shown another embodiment of the invention in which the horseshoe-shaped synthetic resin plate 12 is formed with two spaced parallel legs 20 extending downwardly from the underside of the plate 12 over the thickness of the heel section 14. FIG. 4 shows a shoe having the mid-sole according to the invention applied thereto.

It has been observed in running motion that in the initial stage of each step, the runner strikes the ground at the outside portion of the heel, the runner's weight is instantly moved toward the inner portion to impose the maximum load thereon, and then, is moved from the inner portion of the heel through the middle portion to the forward outer portion of the sole, with the big toe area of which the wearer kicks the ground. This running motion is repeated for each step.

When the maximum load is imposed on the inner portion of the heel section 14, the leg or legs 20 carrys the load so that it or they prevents the inner portion from inclining inwardly of the heel section to provide the wearer with running stability and eliminate any fall and sprain of the wearer. A reaction force to the load imposed on the leg or legs 20 is born by means of the horseshoe-shaped plate 12 placed on the upper periphery of the heel section 14 so that it is distributed over the entire length of the horseshoe-shaped plate 12 to provide a minimum shock to be exerted on the heel of the foot of the wearer. The heel section of the mid-sole made of resilient foam material except for the area occupied by the rigid synthetic resin plate 12 and the leg or legs 20, provides cushioning and is deformable to conform to the heel of the foot to ensure that the wearing comfort at the sole does not deteriorate during running.

I claim:

1. A mid-sole of a shoe comprising a sole body of resilient foam material, and a horseshoe-shaped rigid synthetic resin plate of a desired width having a first portion thereof longer than a second portion thereof and said plate being positioned along the periphery of the upper surface of a heel section of the sole body; said plate including at least one leg secured to said plate and extending downwardly from the under surface of the first portion of the plate a distance equal to the thickness of the heel section, and said at least one leg being embedded in the sole body.

2. A mid-sole of a shoe in accordance with claim 1 wherein said at least one leg is narrower in width than said rigid synthetic resin plate.

3. A mid-sole of a shoe in accordance with claim 1 wherein said leg is made of rigid synthetic resin.

* * * * *